United States Patent [19]

Hastings et al.

[11] Patent Number: 4,520,336

[45] Date of Patent: May 28, 1985

[54] ELECTROTHERMALLY ACTUATED SWITCH

[75] Inventors: Jerome K. Hastings, Sussex; John R. Brubaker, Milwaukee; John W. Kroll, Greendale, all of Wis.

[73] Assignee: Eaton Corporation, Cleveland, Ohio

[21] Appl. No.: 557,130

[22] Filed: Dec. 1, 1983

[51] Int. Cl.[3] ..... H01H 61/06; H01H 71/18

[52] U.S. Cl. ..... 337/140; 337/107

[58] Field of Search ..... 337/140, 395, 102, 107; 60/527

[56] References Cited

U.S. PATENT DOCUMENTS

| | | | |
|---|---|---|---|
| 3,478,292 | 11/1969 | Carter et al. | 337/151 |
| 3,566,328 | 5/1968 | Carter et al. | 337/335 |
| 3,800,260 | 3/1974 | Woodger | 337/49 |
| 4,275,370 | 6/1981 | Sims | 337/140 |
| 4,365,225 | 12/1982 | Olsen et al. | 337/107 |

*Primary Examiner*—Harold Broome

*Attorney, Agent, or Firm*—C. H. Grace; L. G. Vande Zande

[57] ABSTRACT

A thermally responsive shape memory effect (SME) element (4) is positioned adjacent a fixed heater (40) for moving away from the heater to a switch actuating "memory" position as current induced temperature increases, thereby establishing changes in heat transfer coefficient between the heater (40) and thermally responsive element (4) for each increment of movement. An intermediate switch actuating lever (22) is carried on a movable range adjustment lever (16) to vary pretravel of an SME driven plunger (12). The SME element is resettable against a fixed stop (2c) for achieving accurate repetitive resetting of the device.

15 Claims, 5 Drawing Figures

ELECTROTHERMALLY ACTUATED SWITCH

BACKGROUND OF THE INVENTION

The invention disclosed herein pertains to electrothermally actuated switches which are sensitive to variations in current flow for providing overload protection to electrical apparatus. More specifically, the invention relates to overload relays wherein elements constructed of shape memory affect alloys are employed as thermally responsive switch actuating elements.

Overload relays are utilized in circuit with electrical apparatus such as motors or the like to disconnect electric power from the apparatus in the event current flow to the apparatus increases to a level which could potentially damage the apparatus being controlled. U.S. Pat. No. 3,478,292 issued Nov. 11, 1969 to U. F. Carter et al, discloses one form of commercially available overload relay wherein heater coils are disposed around latching, or detent, assemblies which are filled with a eutectic alloy solder. The heater coils are connected in circuit with the controlled electrical load device. Under acceptable current levels the eutectic alloy solder is in a solid form to latch a rotatable shaft rotation by a spring loaded switch actuating mechanism. When current flowing to the controlled device exceeds a predetermined level, it generates heat within the heater coil to cause the eutectic alloy solder to melt, thereby releasing the rotatable shaft and permitting the spring loaded system to drive an operating shaft for actuating switch contacts. The arrangement of the switch contacts and the spring forces of the contacts and operating springs must be carefully determined and selected to achieve the desired operation of the switch contacts. To enable this overload relay to be utilized with load devices having different current ratings, the heater coils must be removed and replaced with similar coils having different thermal outputs.

A similar overload relay is shown in U.S. Pat. No. 3,566,328 issued Feb. 23, 1971 to U. F. Carter et al, wherein the eutectic alloy solder-filled latch structure is replaced by a stacked arrangement of frusto-conical bimetal disks which expand in response to heat generated by the heater coil to drive an actuator mechanism for actuating an overcenter switch contact structure. A limited adjustment to the thermal response of the bimetal disks is provided in this device to calibrate the response of the disks to the tolerances of the particular heater elements utilized. However, the heater coils must be exchanged for coils having different thermal outputs when utilizing this overload relay with a load device of a different current rating.

Another form of commercially available overload relay is disclosed in U.S. Pat. No. 3,800,260 issued Mar. 26, 1974 to F. N. Woodger. In this device a plurality of cantilever supported bimetal members are individually wrapped with heater coils such that the bimetal elements will warp in a given direction in response to heat generated by current passing through the heater coils. The bimetal elements work upon a lever and slide system to operate a snap-action switch contact structure upon a predetermined movement of the lever and slide system. An adjustment mechanism is provided in this device which operates upon the lever and slide system to afford a selective range of currents at which the switch contacts will be actuated. While these devices are satisfactory for their intended purposes, the overload relay of this invention provides improvements thereover.

SUMMARY OF THE INVENTION

The invention disclosed herein provides an overload relay which utilizes a shape memory effect (SME) alloy element as a thermally responsive switch actuating member. By utilizing an SME element of this type, a simple and direct switch actuation structure may be provided. The SME element develops a large amount of force to actuate the switch contacts through a lever system without specfic concern for counteracting spring forces of the switch contact mechanism. A simple flat blade heater element is disposed adjacent the thermally responsive SME element, the latter being arranged to move away from the heater as temperatures increase. This structural arrangement is advantageously incorporated with a relatively large travel available in SME elements to utilize a changing heat transfer coefficient between the heater and the SME element to extend the current range in which the SME element is thermally responsive. The large amount of travel available in the SME element is also utilized in a range adjustment feature to further extend the current range at which switch actuation occurs. The net effect of the aforementioned extensions of operating current range results in a significant reduction in the number of differently rated individual heaters required to provide protection for a full range of load devices. The relay is also repeatedly resettable to a positive starting point to insure constant operation.

The invention and its advantages will become more apparent in the following description and appended claims when read in conjunction with the accompanying drawings.

DESCRIPTION OF THE PREFERRED EMBODIMENT

Figure 2:
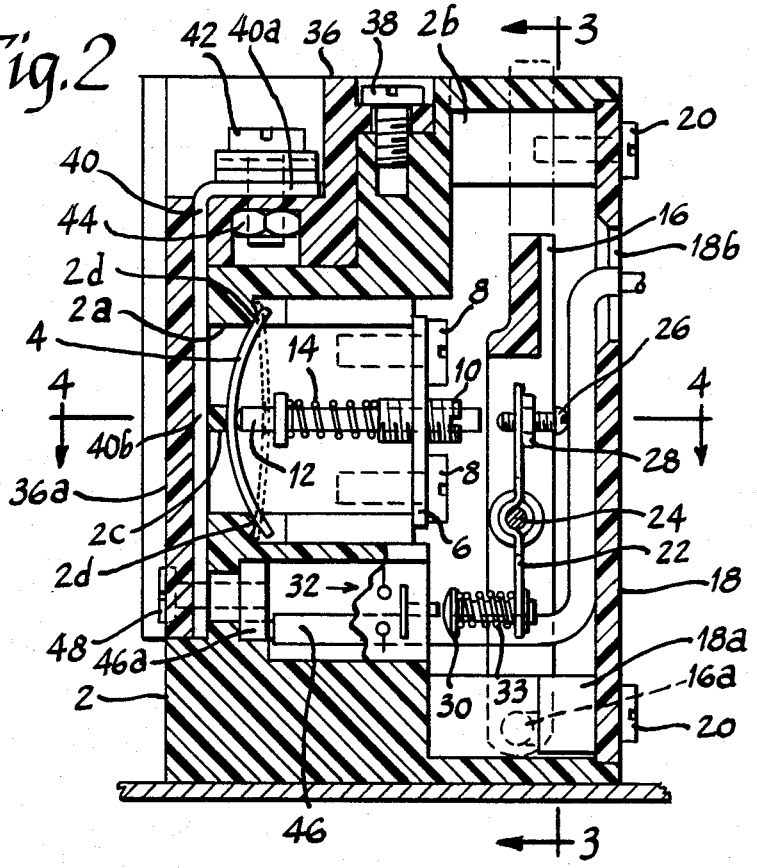
FIG. 2 is a cross sectional view of the overload relay of this invention taken along the line 2—2 in FIG. 1.

The overload relay of this invention comprises a molded insulating housing 2 which has three rectangular cavities **2*a* which extend from the left-hand side of the housing to a larger cavity 2*b* at the right-hand side of the housing as seen in FIG. 2. A narrow web 2*c* extends across the open left-hand end of each cavity 2*a*. Within each cavity 2*a* is disposed a thermally responsive switch actuator element 4 formed of a shape memory effect (SME) alloy. Element 4 is formed to be an essentially flat or slightly bowed rectangular beam in its "memory" shape as indicated by the dotted lines in FIG. 2. From this shape, element 4 is plastically strained to assume a bowed condition to the left as viewed in FIG. 2 and is loosely positioned within the respective rectangular cavity 2*a* to be supported at the upper and lower ends thereof against shoulders 2*d* formed in each cavity. A retaining plate 6 is secured within the interior of housing 2 by a pair of screws 8** to extend across the interior open ends of the three cavities *2a*. Plate 6 is provided with three threaded openings which receive threaded adjusting bushings 10 aligned with each cavity *2a*. A plunger 12 is received within each adjusting bushing 10. Each plunger 12 has an annular shoulder formed near its left-hand end and a compression spring 14 disposed over the plunger between the annular shoulder and the adjusting bushing 10 to bias the plunger leftward as viewed in FIG. 2 against the SME element 4, biasing the element 4 against the web *2c*. Adjustments to the biasing force of spring 14 may be made by threading the adjustment bushing 10 to the left or right as viewed in FIG. 2 within the plate 6.

Figure 1:
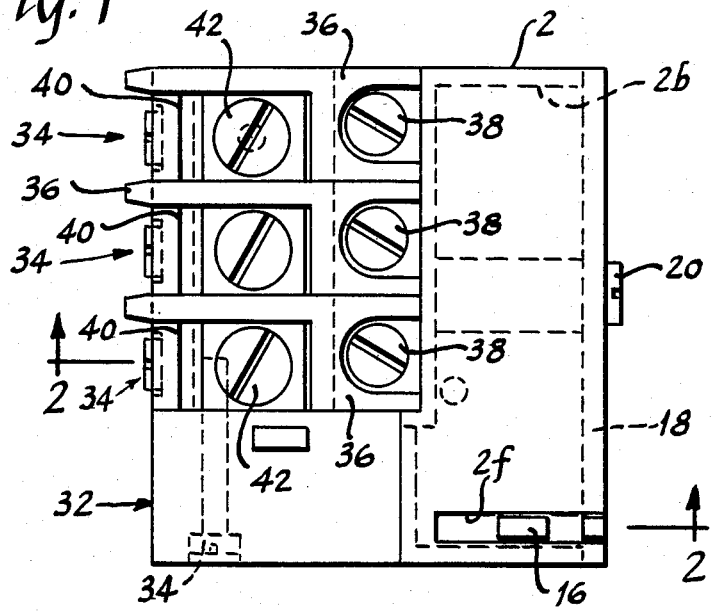
FIG. 1 is a top plan view of an overload relay embodying this invention.
Figure 3:
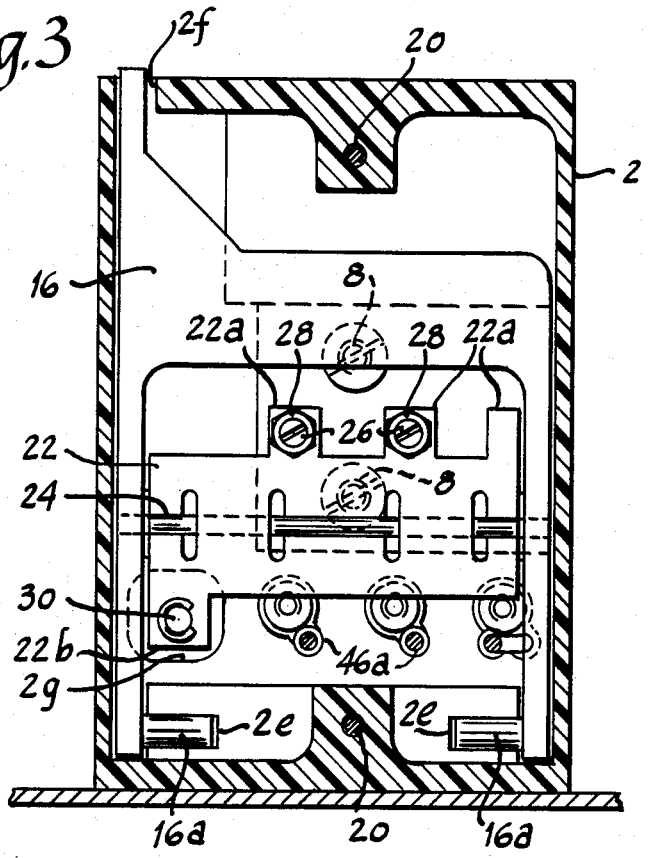
FIG. 3 is a cross sectional view of the overload relay of this invention taken along the line 3—3 in FIG. 2.
Figure 4:
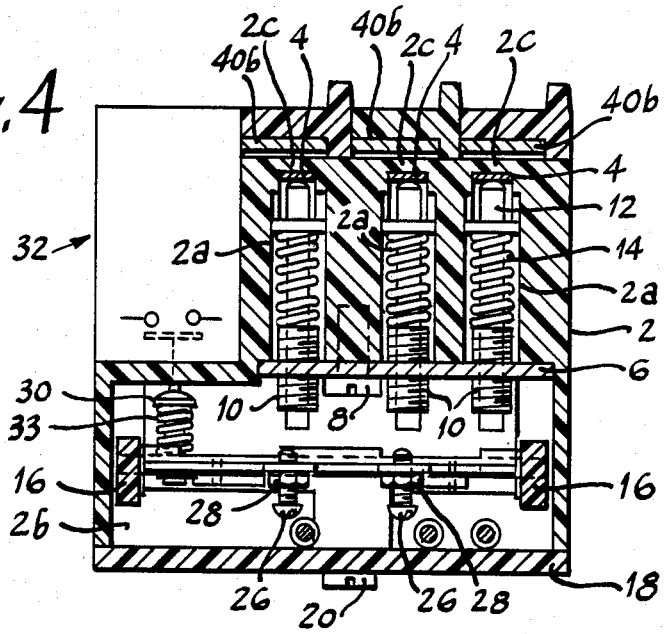
FIG. 4 is a cross sectional view of the relay of this invention taken along the line 4—4 of FIG. 2.

An h-shape range adjustment lever 16 is pivotally mounted within the large cavity *2b* by a pair of axially aligned trunnions *16a* which project inwardly from the lower legs of the lever and are received within slots *2e* formed in the housing 2. The trunnions *16a* are retained in slots *2e* by projections *18a* formed on a cover 18 which is secured across the open side of the cavity *2b* by a pair of screws 20. As seen in FIG. 3, the ascending leg of the h-shaped range adjustment lever 16 projects upwardly through a slot *2f* in housing 2 to afford manual pivotal movement of the range adjusting lever about the trunnions *16a*. A switch actuating lever 22 is pivotally supported between the legs of h-shaped range adjustment lever 16 on a pin 24 which has its opposite ends received in the respective legs. Lever 22 has upwardly extending tabs *22a* formed along its upper surface in alignment with the respective rectangular cavities *2a*. As seen in FIG. 3, the center and left-hand tabs *22a* carry adjustment screws 26 which extend through the threaded holes in the tabs *22a* and are locked in position by hexagonal nuts 28. The threaded shanks of screws 26 project toward plungers 12 in axial alignment therewith. Lever 22 has a depending tab *22b* extending from the bottom edge thereof at the left-hand end as seen in FIG. 3. The tab *22b* has a hole in which a plunger 30 is slidably mounted to the lever 22. A spring 33 is disposed over the shank of plunger 30 and bears between the tab *22b* and a headed end of the plunger 30 to bias the plunger 30 away from the lever 22. A self-contained switch unit 32 is attached to housing 2 at one corner thereof by a screw 34 (FIGS. 1 and 4) and an opening *2g* (FIG. 3) is provided in the wall of the housing 2 to enable a plunger of the switch unit 32 to project into the cavity *2b* in alignment with plunger 30. The details of the particular switch 32 are not pertinent to this invention, and therefore the switch 32 has been depicted schematically in FIGS. 2 and 4.

Completing the overload relay of this invention is a plurality of heater subassemblies 34 which are attached to the left-hand side of the housing as viewed in FIG. 2 in alignment with respective ones of the rectangular cavities *2a*. Each heater unit subassembly 34 comprises a molded base 36 which is secured to the top surface of the housing 2 by a screw 38. Base 36 has a depending leg *36a* extending downwardly along the left-hand side of housing 2 as viewed in FIG. 2 to cover the open end of the respective cavity *2a*. A flat strip heater element 40 is formed into an L-shape and is mounted to the base 36 in an inverted position. The shorter leg *40a* rests upon an upper surface of base 36 and the longer leg *40b* thereof extends downwardly inside the leg *36a* of base 36 to be immediately adjacent the respective cavity *2a*. A screw and wearing clip assembly 42 is provided in the upper leg *40a* of heater 40, the screw 42 passing through an opening in the base 36 to threadably engage a hexagonal nut 44 trapped within an opening in the underside of base 36. The lower end of leg *40b* of the heater element 40 is electrically connected to a terminal end *46a* of a conductor wire assembly 46 by a screw 48 which passes through aligned openings in base 36 and heater element 40 to threadably engage the terminal *46a*. As seen in FIG. 2, conductor wire 46 extends to the right into cavity *2b* along a lower portion of housing 2 and then extends upwardly along the interior of cover plate 18 to project exteriorly of the relay through holes *18b* in the cover 18 for connection in circuit with a load device which is to be protected by the overload relay.

In operation, the terminals 42 are connected to incoming power lines and the wire conductors 46 are connected to the load device to be monitored. The contacts of the switch 32 are connected in circuit with a contactor or other control device for the load device. SME element 4, when in its cool state, is biased to a bowed condition by the plunger 12 and biasing spring 14, such that the central portion of the SME element abuts the fixed stops *2c* within the respective cavities *2a*. Current passing through the heater strip 40 to the load device generates heat within the strip 40 in proportion to the amount of current flow therethrough. In the event that the current flow exceeds a desired amount, the heater 40 will generate a sufficient amount of heat to cause the SME element to enter into its transition stage, whereby it will move toward its flat "memory" shape. Such movement of the element 4 will drive plunger 12 to the right as seen in FIG. 2 against the bias of spring 14 and cause the right-hand end of plunger 12 to engage the end of screw 26 to pivot the switch actuating lever clockwise about the pin 24, thereby causing plunger 30 to depress the actuator of switch 32 to actuate the contacts thereof. It will be appreciated that with the range lever 16 positioned as shown in FIG. 2, the plunger 12 must undergo a certain amount of pretravel before it engages the screw 26 to effect actuation of switch 32. By pivoting the range lever to the right or left as seen in FIG. 2, the gap between plunger 12 and screw 26 may be adjusted to increase or decrease the amount of pretravel. The SME element 4 requires a rise of approximately 20° C. to complete its transition to its martensite or "memory" state and, therefore, to fully move from its cooled solid line position to the dotted line "memory" position. Accordingly, if the range adjustment lever 16 were rotated counterclockwise to the left as viewed in FIG. 2 so as to decrease the gap between the plunger 12 and screw 26 to a small amount or to bring screw 26 into immediate engagement with the end of plunger 12, switch actuation will occur in the early increment of travel of SME element 4. When so adjusted, the relay will respond to a low amount of current exceeding the desired current level, whereas if the range lever is moved to its full right-hand position as viewed in FIG. 2, the maximum gap will be provided between the end of plunger 12 and screw 26 whereby significantly higher current flow will be required to generate sufficient heat to cause the thermally responsive SME element 4 to move to its fully displaced "memory" position. In this way, a range of currents at which the relay will operate the switch contacts 32 may be provided by the range adjustment lever 16.

Figure 5:
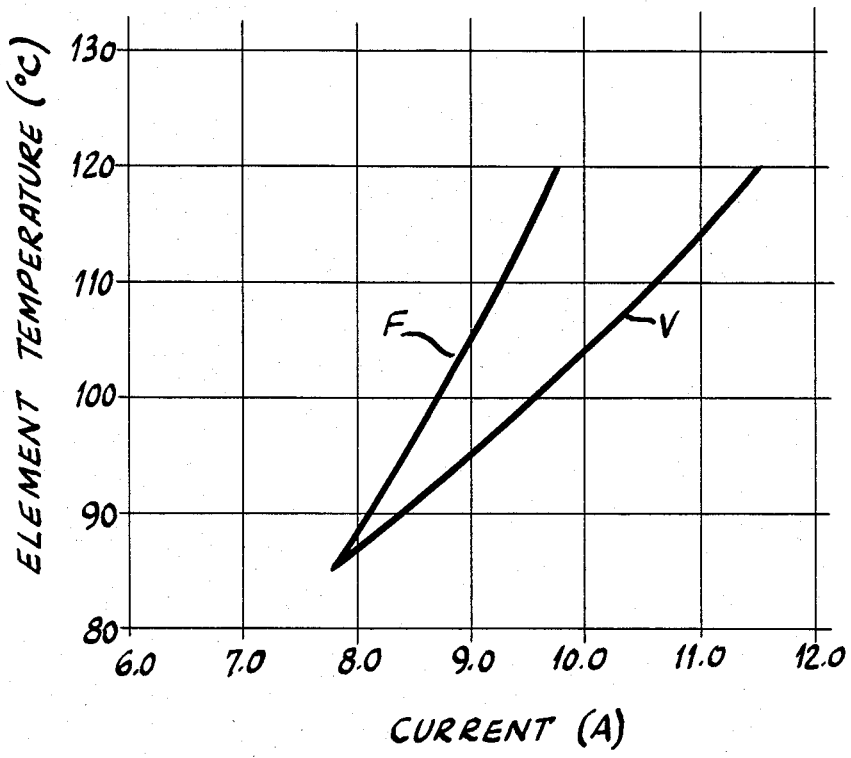
FIG. 5 is a graph depicting an extended operating current range obtained through utilization of the change of heat transfer coefficient between the heater and the thermally responsive element.

The operating current range provided by a particular heater element 40 is further extended by the peculiar structural arrangement of this invention. Due to the large amount of movement possible in an SME element, it has been discovered that by locating the heater element stationarily along one side of the SME element 4, the heat transfer coefficient between the heater and the SME element changes with each increment of travel of the SME element away from the heater in the right-hand direction as viewed in FIG. 2. Current flowing through heater element 40 may generate heat which is adequate to start the transitional movement of SME element 4 to the right as viewed in FIG. 2. However, as the SME element 4 moves away from the heater element 40, a new coefficient of heat transfer is established between these two elements and if the same current level is maintained in the heater element 40, it will no longer heat the SME element sufficiently to sustain movement of that element. Thus, the current flowing in heater 40 must increase to sustain movement of the thermally responsive SME element 4 because its heat transfer coefficient with the heater is constantly changing for each increment of travel of the SME element. Accordingly, this arrangement provides a significant increase in the operating current range for the overload relay of this invention over other devices wherein the heat transfer coefficient between the heater and thermally responsive element is fixed, such as by surrounding or wrapping the thermally responsive element with the heater. FIG. 5 depicts displacement curves for a thermally responsive element such as SME element 4. Curve F represents such an element having a fixed heat transfer coefficient and can be seen to begin movement at a current of approximately 7.8 amps and at a temperature of approximately 85° C. A 45° C. rise in temperature of the element to approximately 120° C. effects full displacement of the element which occurs at a current level of approximately 9.8 amps. Curve V represents the displacement of the same element 4 having the variable heat transfer coefficient of this invention. It can be seen from this graph that initial movement occurs at the same 7.8 amp current level, but that a current level of 11.5 amps is required to generate sufficient heat to cause full displacement of the element 4. Accordingly, the operating current range for the variable heat transfer coefficient arrangement of this invention is extended more than 80%. This current range extension coupled with the current range extension provided by range adjustment lever 16 serves to greatly increase the current ranges for which the overload protective relay is operable and, therefore, greatly reduces the number of individual heater elements that may be required to provide a protective device for the wide range of ratings of load devices with which this device is intended to be used.

When current flow to the load device is interrupted, such as by actuation of switch 32, the SME element 4 will cool in the absence of heat generated by heater element 40. Such cooling will enable the spring 14 to bias the SME element 4 to the bowed condition depicted in solid lines in FIG. 2 against the fixed stop 2*c*. This movement enables the switch 32 to return to its deactuated position. The provision of fixed stop 2*c* assures that the overload relay SME element 4 will be reset to the identical condition each time resetting occurs. Although the SME element 4 has been depicted herein as a one-way element, a two-way SME element could also be used wherein the SME element would automatically return to its left-hand position upon cooling. In this instance, the spring 14 could be omitted or a spring having significantly less force could be substituted therefore merely to cause the plunger 12 to follow the SME element 4.

While the improved electrothermally actuated switch of this invention has been described in connection with a particular embodiment of overload relay herein, it is to be understood that the invention is susceptible to various modifications without departing from the scope of the appended claims.

We claim:

1. An electrothermally actuated switch comprising, in combination:

switch means;

a heater for receiving current flow therein producing heat levels indicative of the current levels flowing therein;

thermally responsive means having an initial position in heat conducting proximity to said heater establishing a coefficient of heat transfer from said heater to said thermally responsive means, said thermally responsive means being temperature actuated for progressive movement away from said heater and operable upon a predetermined amount of said movement for actuating said switch means;

and wherein said progressive movement of said thermally responsive means within said predetermined amount of said movement progressively decreases said coefficient of heat transfer thereby requiring increased current levels and resulting heat levels for maintaining said progressive movement of said thermally responsive means, thereby to extend a range of current levels at which switch actuation occurs.

2. The invention defined in claim 1 wherein said predetermined amount of said movement is selectively adjustable for varying the current level at which switch actuation occurs.

3. The invention defined in claim 1 wherein said thermally responsive means comprises shape memory effect (SME) means.

4. The invention defined in claim 3 wherein said SME means is restorable toward said initial position in response to reductions in said heat levels.

5. The invention defined in claim 4 further comprising stop means cooperable with said SME means for positively locating said initial position of said SME means.

6. The invention defined in claim 5 wherein said stop means are fixedly positioned relative to said SME means.

7. The invention defined in claim 6 wherein said stop means defines said initial position of said SME means as being spaced from said heater.

8. The invention defined in claim 3 further comprising biasing means opposing said movement.

9. The invention defined in claim 8 wherein said biasing means urges said SME means toward said initial position upon reduction of said heat levels and cooling of said SME means.

10. The invention defined in claim 9 further comprising stop means cooperable with said SME means for positively locating said initial position of said SME means.

11. The invention defined in claim 10 wherein said stop means are fixedly positioned relative to said SME means and said biasing means urges said SME means against said stop means upon reduction of said heat level and cooling of said SME means.

12. The invention defined in claim 11 wherein said stop means defines said initial position of said SME means as being spaced from said heater.

13. The invention defined in claim 3 wherein said SME means comprises an elongated member supported at opposite ends and centrally bowed toward said heater in said initial position, and wherein temperature actuation of said SME member causes said member to move toward a straighted condition.

14. In an electrothermally actuated overload relay wherein shape memory effect (SME) means is disposed in an initial condition positioned with respect to a current responsive heater element and is thermally responsive to current induced temperatures for movement to a displaced condition for actuating switch means at an adjustably selected current level within a predetermined range of current levels, the invention comprising fixed stop means against which said SME means is biased at a current level below a lower limit of said predetermined range for positive resetting of said SME means to said initial condition.

15. In an electrothermally actuated overload relay wherein shape memory effect (SME) means is positioned in proximity to a current responsive heater element and is thermally responsive to current induced temperatures for movement from an initial position toward an adjustable switch actuating position at a selected current level from a predetermined range of current levels and is restorable to said initial position upon reduction of said current level below a lower limit of said predetermined range of current levels, the invention comprising fixed stop means cooperating with said SME means for positively locating said initial position.

* * * * *